US006183000B1

(12) United States Patent
Piatti

(10) Patent No.: US 6,183,000 B1
(45) **Date of Patent: *Feb. 6, 2001**

(54) SNOWBOARD, SURFBOARD, MONOSKI, WATER-SKI AND THE LIKE WITH VERY LOW WEIGHT AND HIGH MECHANICAL STRENGTH

(75) Inventor: Alberto Piatti, Margno (IT)

(73) Assignee: Alpitech S.r.l., Sondrio (IT)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/938,696

(22) Filed: Sep. 26, 1997

(30) Foreign Application Priority Data

Dec. 4, 1996 (IT) ..... MI96A2549
Feb. 3, 1997 (IT) ..... MI97A0206

(51) Int. Cl.[7] ..... A63C 5/00
(52) U.S. Cl. ..... 280/610
(58) Field of Search ..... 280/14.2, 602, 280/608, 610; 428/102, 223; 441/65, 68, 74

(56) References Cited

U.S. PATENT DOCUMENTS 2,908,506 * 10/1959 Runton ..... 280/11.13
5,544,908 * 8/1996 Fezio ..... 280/610
5,746,537 * 5/1998 Kellas ..... 404/6
5,769,445 * 6/1998 Morrow ..... 280/610
5,888,329 * 3/1999 Cho et al. ..... 156/93

FOREIGN PATENT DOCUMENTS 42 33 647 4/1994 (DE) .
2 667 536 4/1992 (FR) .
2 704 155 10/1994 (FR) .

* cited by examiner

*Primary Examiner*—Kevin Hurley
*Assistant Examiner*—Kevin McKinley
(74) *Attorney, Agent, or Firm*—Guido Modiano; Albert Josif; Daniel O'Byrne

(57) ABSTRACT

A snowboard and the like with very low weight and high mechanical strength, comprising a core made of foamed plastics which is arranged between a lower layer and an upper layer of fabric impregnated with epoxy resins. The core can be shaped and rigidly coupled to the layers by molding in a heated mold. There is also provided a base with a corresponding lamina, associated with the lower layer, and a topskin element associated with the upper layer.

20 Claims, 5 Drawing Sheets

10
11
9
12
3
8
2
1
16
20
20
10
16
20

1
5
10
11
12
13
20
21
22

SNOWBOARD, SURFBOARD, MONOSKI, WATER-SKI AND THE LIKE WITH VERY LOW WEIGHT AND HIGH MECHANICAL STRENGTH

BACKGROUND OF THE INVENTION

The present invention relates to a snowboard with very low weight and high mechanical strength.

Snowboards, surfboards, monoskis, water-skis and the like are conventionally manufactured according to two basic construction criteria which are derived from skiing: in particular, there are injection-molded boards and so-called sandwich boards.

Injection-molded boards use a mold into which the materials that constitute the lower part and the upper part of the snowboard are placed, injecting polyurethane of appropriate density which, by expanding, forms the core of the board.

This solution does not yield optimum results, since there are considerable difficulties in achieving high mechanical strength of the board; considerable weights are also obtained.

The sandwich method uses a wood core which has a structural function and is placed inside layers of stiffening material of various kinds, placed between a base and a topskin.

Two shaped elements made of plastics, generally ABS, are added to the wood core and form the ends; this solution, however, is not ideal, since inevitably there is a discontinuity between the shaped ends and the central part where the core is provided. Moreover, in order to round the edges of the board, as typically occurs, it is necessary to carry out preliminary machining of the edge of the wood core before embedding it between the layers of stiffening material of various kinds, with application of the laminae and of the lower base and of the upper topskin.

Although these boards have better mechanical strengths than boards produced by injection molding, they are not free from drawbacks, including the poorly bonded connection between the ends and the core and a relatively high weight, in addition to risks of deformation caused by the use of wood.

SUMMARY OF THE INVENTION

The aim of th e present invention is to eliminate the drawbacks mentioned above, by providing a snowboard with high mechanical strength which, although having a sandwich-type structure, makes it possible to have a core which can be shaped even at the tips without having to resort to addition al elements.

Within the scope of this aim, a particular object of the present invention is to provide a snowboard which, while having great mechanical resistance to flexural and torsional stresses, is particularly lightweight and in any case is distinctly lighter than conventional boards, in addition to significantly improving their performance.

Another object of the present invention is to provide a board which allows to provide board stiffening elements so as to adapt to the different performance characteristics to be provided.

Another object of the present invention is to provide a snowboard with high mechanical strength which can be easily obtained starting from commonly commercially available elements and materials and is furthermore competitive from a purely economical point of view.

This aim, these objects and others which will become apparent hereinafter are achieved by a snowboard with high mechanical strength, according to the invention, characterized in that it comprises a core made of foamed plastics which is arranged between a lower layer and an upper layer of fabric impregnated with epoxy resin, and in that said core can be shaped and rigidly coupled to said layers by molding in a heated mold, a base with a corresponding lamina, associated with said lower layer, and a topskin element, associated with said upper layer, being also provided.

BRIEF DESCRIPTION OF THE DRAWINGS

Further characteristics and advantages of the present invention will become apparent from the following detailed description of a preferred but not exclusive embodiment of a snowboard with high mechanical strength, illustrated only by way of non-limitative example in the accompanying drawings, wherein.

DESCRIPTION OF THE PREFERRED EMBODIMENTS

Figures 1, 2:
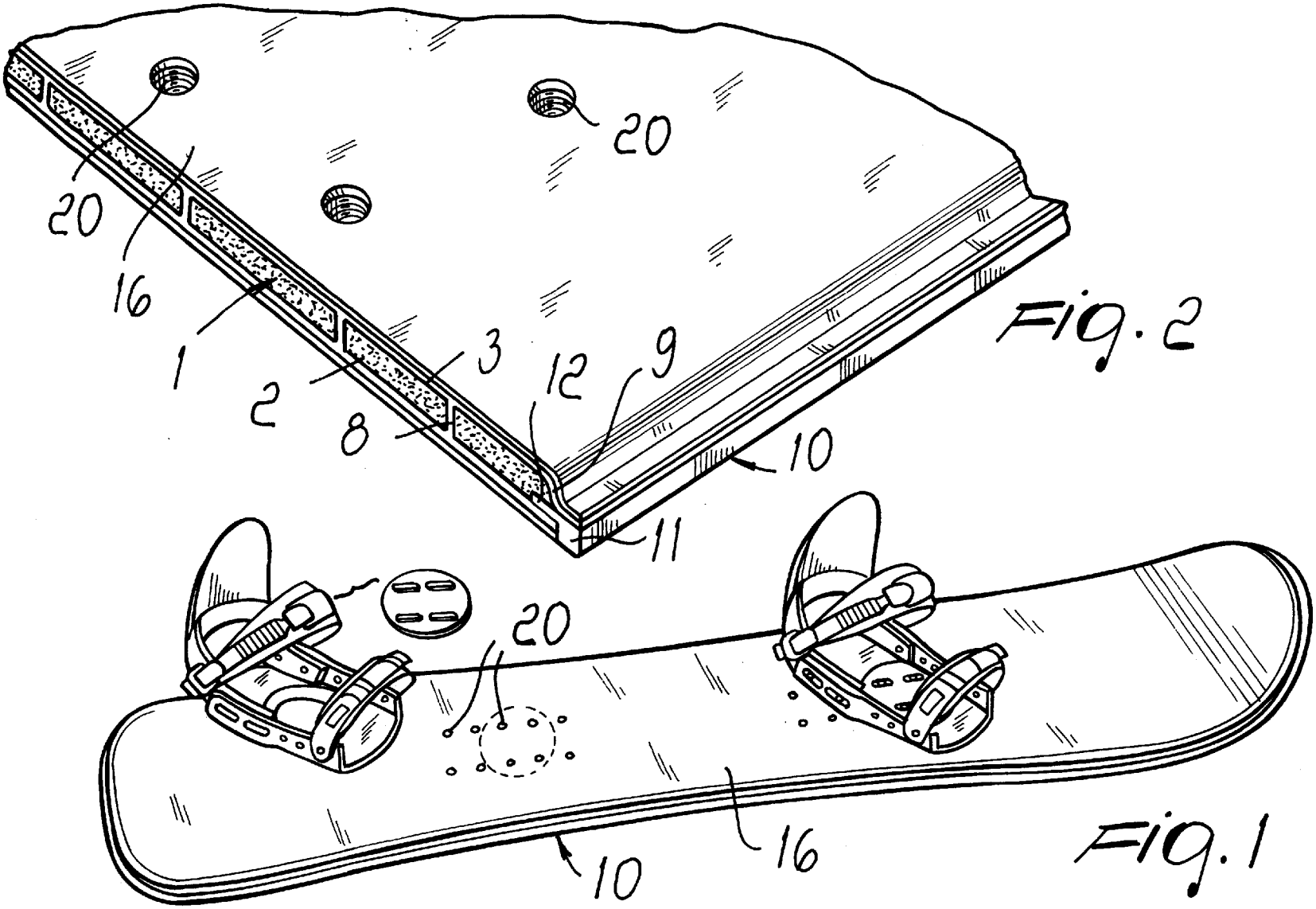
FIG. 1 is a schematic perspective view of the snowboard according to the present invention.
FIG. 2 is a schematic sectional view of the snowboard.
Figure 3:
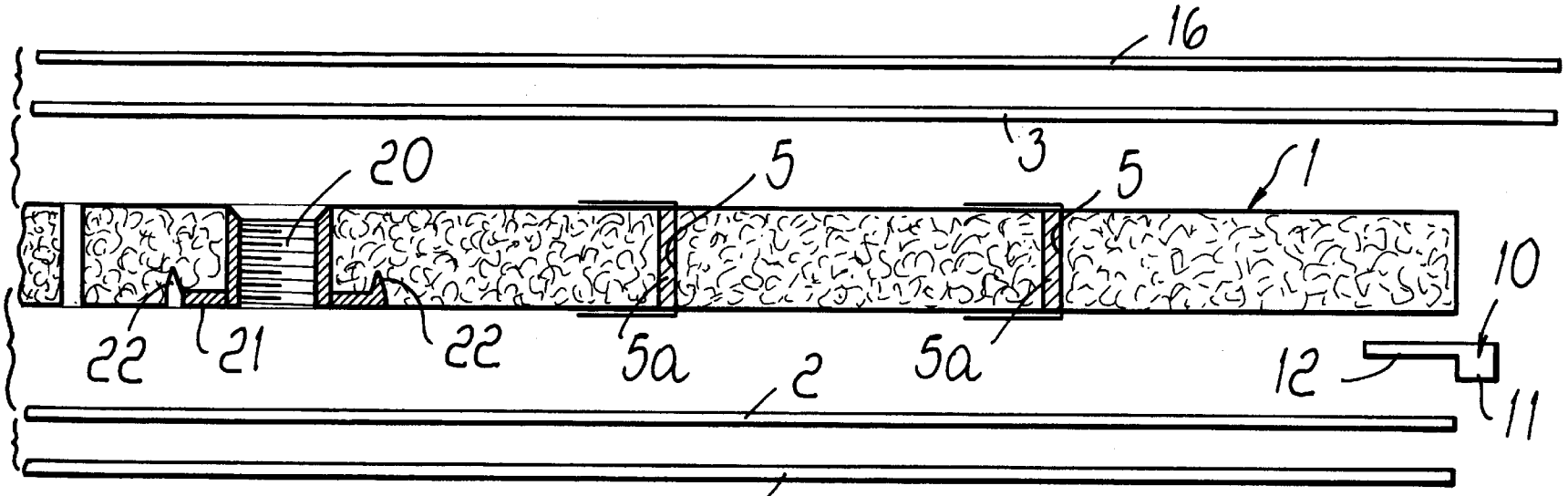
FIG. 3 is an exploded view of the layers that constitute the snowboard.
Figure 4:
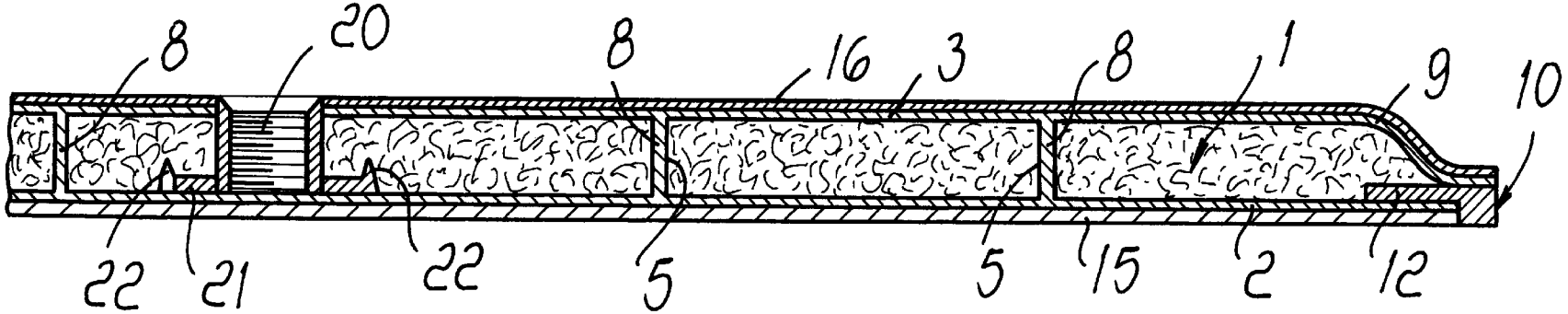
FIG. 4 is an enlarged-scale sectional view of the snowboard.
Figures 5, 6, 7, 8, 9:
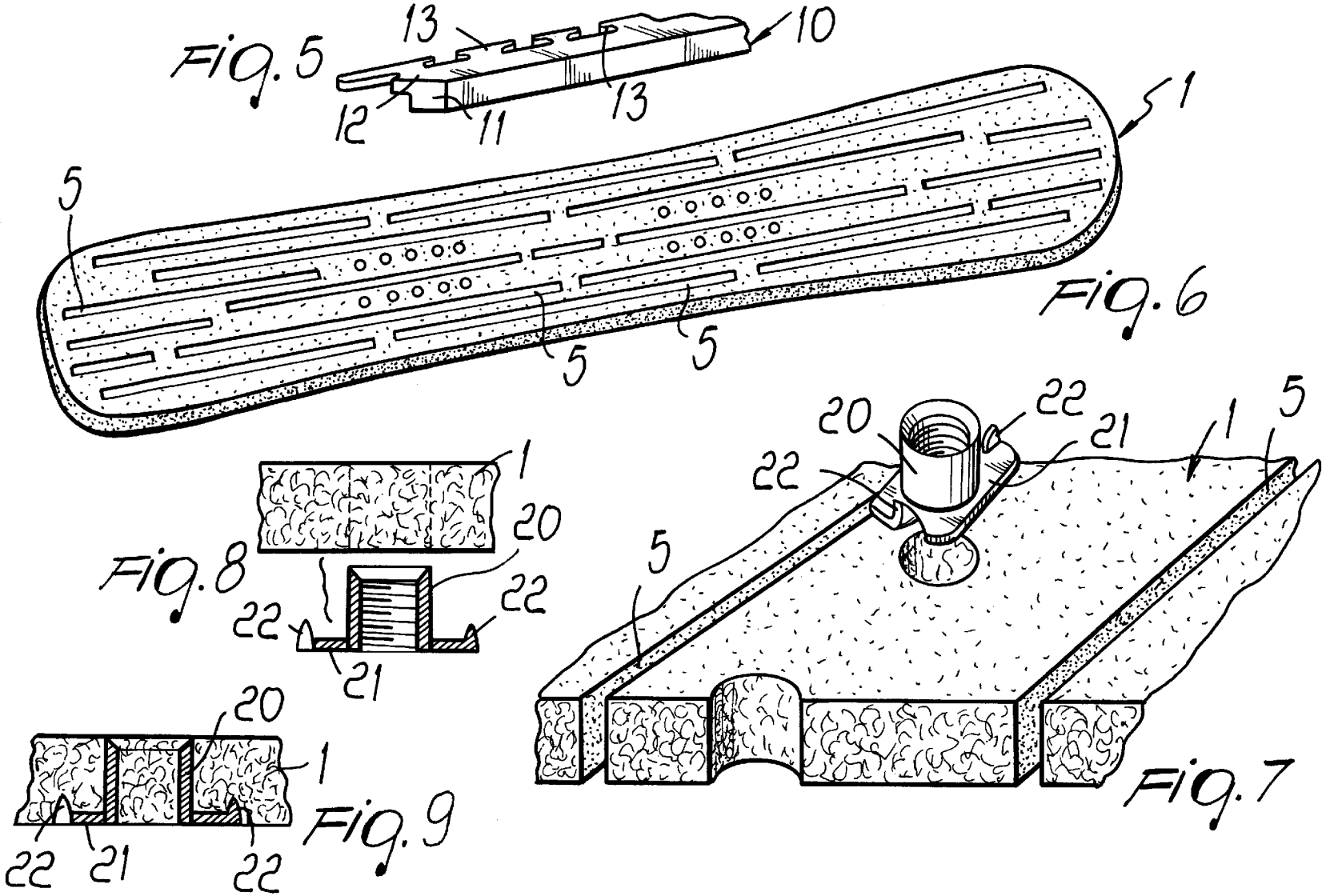
FIG. 5 is a perspective view of the shape of the lamina.
FIG. 6 is a view of a possible configuration of the core.
FIG. 7 is an exploded view of the core and of a bush for connecting the bindings.
FIG. 8 is an exploded sectional view of the core and of the bush.
FIG. 9 is a sectional view of the bush inserted in the core.

With reference to the above figures, the snowboard with high mechanical strength, according to the present invention, comprises a core 1 made of foamed plastics, which is preferably constituted by an expanded foam of structural polyvinyl chloride (PVC) with a relative density of preferably 100 kg/m$^3$.

In the tests that were conducted, the material that was found to be optimum is the one known commercially by the trade-name Klegecell, which is manufactured with densities between 55 and 130 kg/m$^3$ and has optimum workability and gluing characteristics together with optimum mechanical strength.

The best compromise between weight, deformability, structure and strength is achieved, as mentioned above, by using a material which has a density of 100 kg/m$^3$.

The core 1, which is shaped in the manner deemed optimum, is interposed between a lower layer 2 and an upper layer 3 of fabric impregnated with epoxy resins.

The layer 2 and the layer 3 in practice have the core embedded therein; said core can have slots 5 which can be filled with fabrics pre-impregnated with epoxy resins and compatible adhesives 5*a* and allow to provide, in practice, stiffening ribs which, by passing through the core, mutually join the upper layer and the lower layer, so as to achieve optimum mechanical strength as a function of the intended characteristics.

The accompanying drawings illustrate an arrangement of the slots 5 which is merely an example; the actual distribution depends on the torsional and flexural characteristics that the board is to assume.

The coupling between the core 1 and the layers 2,3 is provided by means of a heated mold, which allows to shape the core by forming a tapered region 9 at the edges and also allows to form the intended curvature of the end regions, providing deformation of the core made of structural PVC expanded foam by heat and by compression.

The resin of the impregnated fabric also melts simultaneously, rigidly coupling the core and furthermore providing ribs 8, which mutually join the upper layer 3 and the lower layer 2.

The lamina 10 arranged at the edge is also embedded during this step; said lamina has a working portion 11 from which a wing 12 extends which is retained between the layers and is provided with sets of teeth 13 which the plastic material enters in order to prevent extraction.

The assembly is completed by a base 15 which is coupled to the lower layer and by a topskin element 16 which is superimposed on the upper layer 3 and mainly has an aesthetic finishing function.

Before placing the core 1 in the mold, threaded bushes 20 are applied and form the seats for coupling the bindings of the board; the bushes 20 are connected, at one end, to a flange 21 with claws 22 which have the purpose of entering the core 1 to prevent rotation and provide a firm coupling. The shape of the bushes 20 is such that in practice they remain trapped between the lower layer 2 and the upper layer 3 and are advantageously shaped so as to form an impression on the topskin element 16, so as to make them visible.

It should also be noted that the insertion of the bushes 20, which have a cylindrical shape, in the core 1 by pressing causes the material of the core to remain inside the bushes, so that during the melting of the epoxy resins the resins cannot enter the bushes 20, making subsequent cleaning very easy.

Another problem observed in the production of snowboards and surfboards relates to the separation of the core 1 from the outer layers 2,3.

Figure 10:
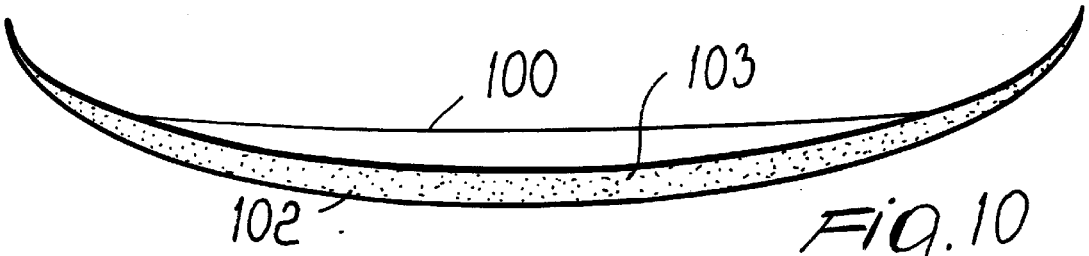
FIG. 10 is a schematic sectional view of a board according to the prior art, illustrating the separation of a layer from the core.
Figure 11:
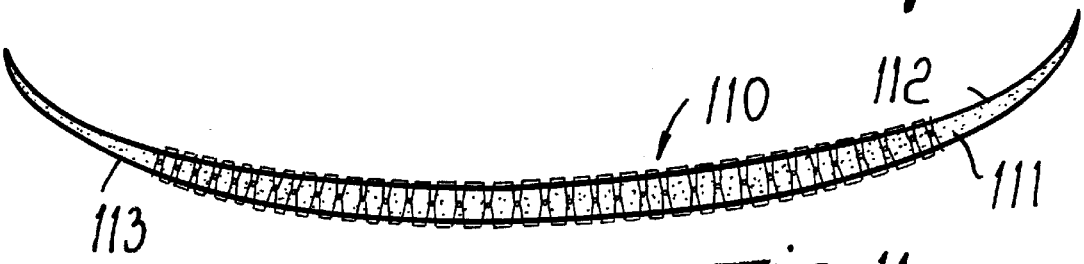
FIG. 11 is a sectional view of the snowboard, surfboard and the like according to the invention.

As shown schematically in FIG. 10, the structural layers 100 and 102 arranged outside the core 103 tend to separate from said core in case of compression generated by continuous and violent stresses.

With reference to FIGS. 10 to 17, the snowboard, surfboard, water ski, monoski and the like, now designated by the reference numeral 110, is constituted by a sheet-like core 111 to which an upper layer 112 and a lower layer 113 are connected; said layers are made of glass, dry composite material, fabric or the like which are impregnated with plastic resins, such as for example epoxy resins and the like.

The important particularity of the present invention is constituted by the fact that the layers 111 and 112 are mutually joined by filament-like binding means provided by means of stitches 120 formed with filaments having different diameters and made of different materials, such as for example nylon, carbon, Kevlar or glass or other materials.

Figure 15:
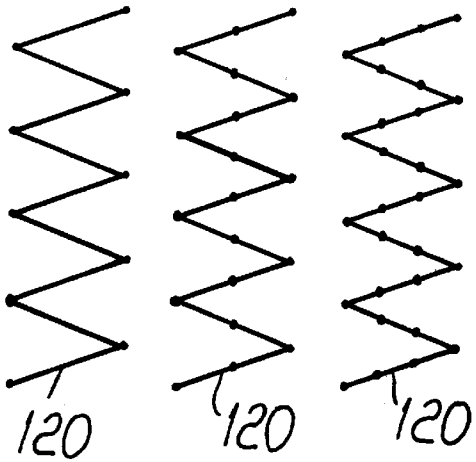
FIG. 15 is a view of some possible embodiments of the stitches.
Figure 17:
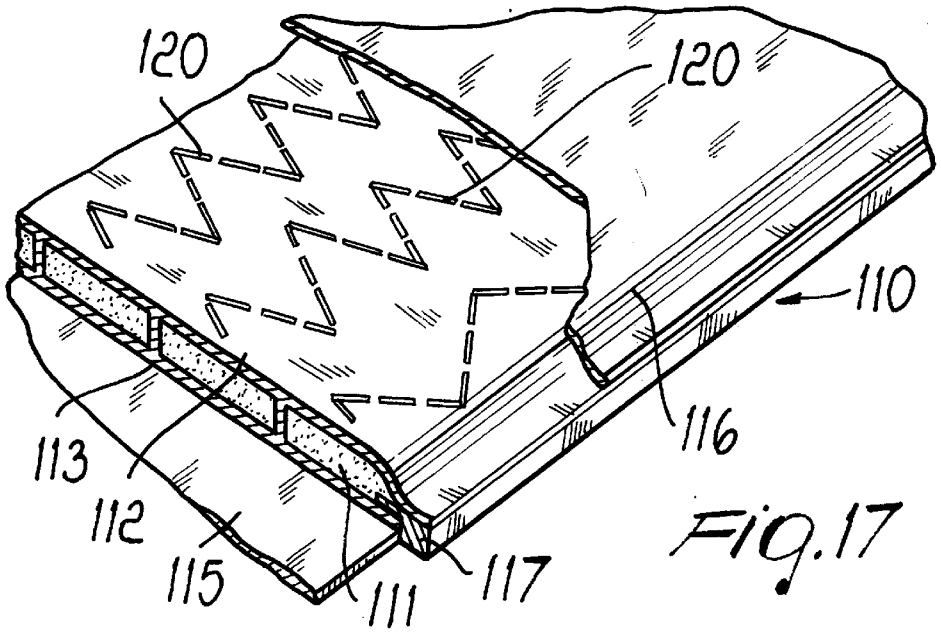
FIG. 17 is a sectional view of a board with its layers exposed.

The stitches preferably run along the longitudinal direction of the extension of the board 110 and are formed with a zigzag system composed of 2, 4 or 6 stitches, as shown in FIG. 15.

Figure 12:
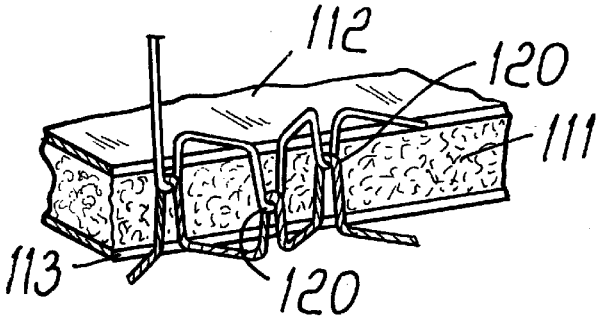
FIG. 12 is a schematic perspective view of the means for binding the layers to the core.
Figure 13:
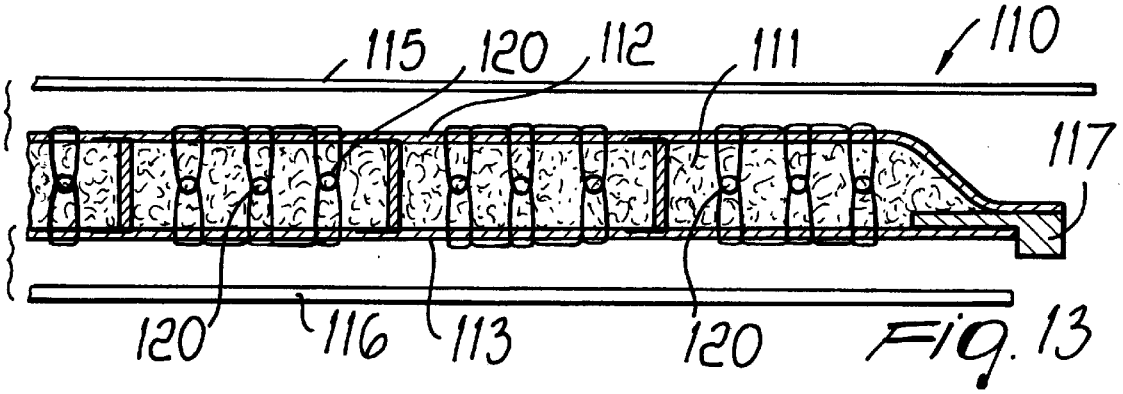
FIG. 13 is a schematic exploded transverse sectional view of the board, illustrating the binding means and the component layers.
Figure 14:
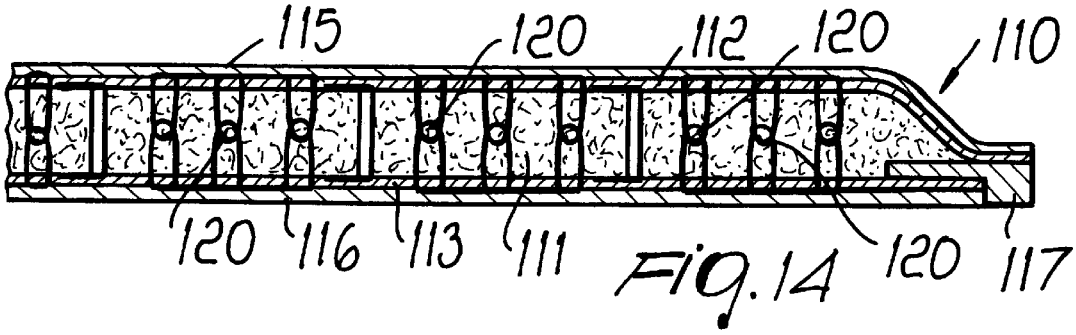
FIG. 14 is a sectional view of a board.
Figure 16:
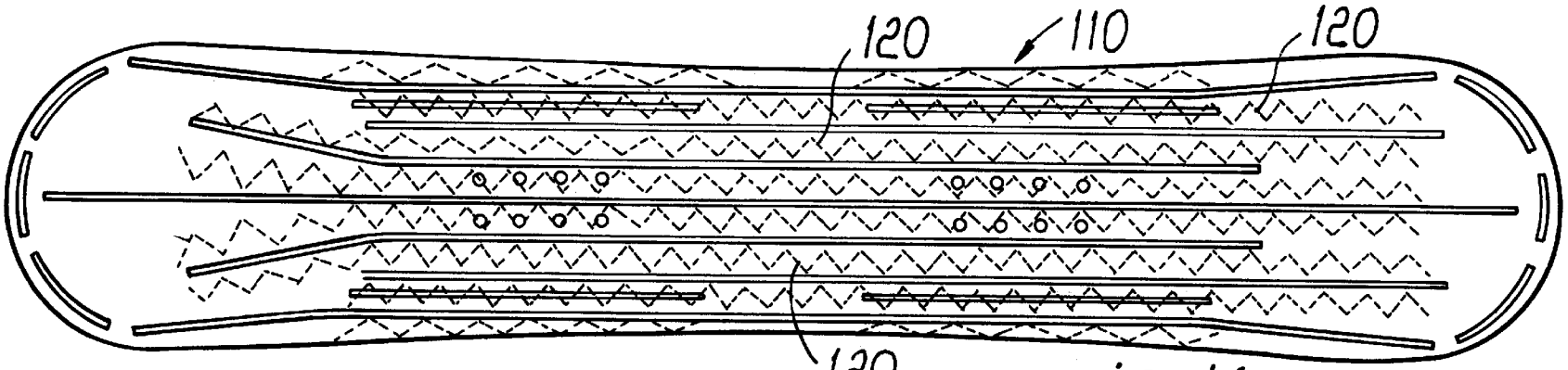
FIG. 16 is a schematic plan view of a board.

Binding so as to close the various stitches is performed every time the filament passes through the core, as clearly shown in FIG. 12.

The conventional base 115 and the topskin 116 are furthermore connected above the lower and upper layers 112, 113 and a lamina 117 is provided, according to the characteristics of conventional manufacture of a board.

The presence of the binding means is particularly important, since separation of the core 111 from the lower and upper layers 112, 113 is absolutely prevented even in all those regions which are subjected to compression in case of violent and continuous stresses.

The stitches 120 in practice form a highly stable and solid coupling which allows to ensure strength and durability of the board.

Use of the core 1, 111 made of expanded structural polyvinyl chloride foam furthermore allows to have considerable mechanical strength together with a very light weight of the board, with the further advantage of being able to provide binding by passing the thread through the core without having to use complex and expensive equipment.

From the above description it is thus evident that the invention achieves the intended aim and objects, and in particular the fact is stressed that it is possible to obtain a snowboard having high mechanical strength, substantially modifying conventional manufacturing criteria, since a core made of expanded structural plastic foam is provided which allows to have the intended mechanical strength characteristics together with a very light weight.

Moreover, the possibility of easily machining the core made of expanded structural PVC foam allows to form stiffening elements or ribs obtained simply by means of slots which are preset in the core and are then filled by the epoxy resin during molding.

From the above description it is thus evident that the invention achieves the intended aim and objects, and in particular the fact is stressed that the snowboard uses a sandwich manufacturing criterion but does not have the shortcomings and drawbacks which are typical of this solution.

The invention thus conceived is susceptible of numerous modifications and variations, all of which are within the scope of the inventive concept.

All the details may furthermore be replaced with other technically equivalent elements.

In practice, the materials employed, as well as the contingent shapes and dimensions, may be any according to requirements.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

What is claimed is:

1. A snowboard or surfboard or monoski or water-ski with high mechanical strength, comprising a core made of foamed plastics which is arranged between a lower layer and an upper layer of fabric impregnated with epoxy resin, wherein said core can be shaped and rigidly coupled to said layers by molding in a heated mold, a base with a corresponding lamina, associated with said lower layer, and a topskin element, associated with said upper layer, being also provided, filament-like binding means mutually joining said lower layer and said upper layer and passing through said core.

2. The snowboard according to claim 1, wherein said filament-like binding means are constituted by set of stitches.

3. The snowboard according to claim 1, wherein said binding means are provided by means of a nylon filament.

4. The snowboard according to claim 1, wherein said binding means are obtained by means of a carbon filament.

5. The snowboard according to claim 1, wherein said binding means are constituted by a Kevlar filament.

6. The snowboard according to claim 1, wherein said filament-like binding means are obtained by means of a glass filament.

7. The snowboard according to claim 1, wherein said core is made of expanded structural polyvinyl chloride foam.

8. The snowboard according to claim 1, wherein said core is made of expanded polyvinyl chloride foam with a density of 55–130 $kg/m^3$.

9. The snowboard according to claim 1, wherein said core is made of expanded structural polyvinyl chloride foam with a relative density of 100 $kg/m^3$.

10. The snowboard according to claim 1, further comprising, on said core, slots which are suitable to be filled with fabrics impregnated with epoxy resins and suitable to mutually rigidly couple said upper layer and said lower layer.

11. The snowboard according to claim 1, wherein said core undergoes compression and shaping in said mold.

12. The snowboard according to claim 1, further comprising threaded bushes inserted in said core before its insertion between said lower and upper layers, said bush forming, at the end of the molding process, an impression in said topskin element to determine the positioning of said bushes.

13. The snowboard according to claim 1, comprising a sheet-like core placed between said lower layer and said upper layer which are impregnated with plastic resin.

14. The snowboard according to claim 2, wherein said set of stitches is of the zigzag type.

15. The snowboard according to claim 2, wherein said set of stitches runs longitudinally and/or transversely with respect to the extension of said board.

16. The snowboard according to claim 2, wherein said set of stitches are tied every time the thread passes inside said core.

17. The snowboard according to claim 2, wherein said set of zigzag stitches is formed by 2, 4 or 6 stitches.

18. The snowboard according to claim 2, wherein each stitch of said set of stitches is obtained by means of a double passage of thread through said upper layer, lower layer and core.

19. The snowboard according to claim 10, further comprising, in said slots, ribs for stiffening said snowboard.

20. The snowboard according to claim 12, wherein said bushes comprise, at an axial end, a flange with claws which can be inserted in said core.

* * * * *